US011270655B2

(12) United States Patent
Wang et al.

(10) Patent No.: US 11,270,655 B2
(45) Date of Patent: Mar. 8, 2022

(54) DISPLAY APPARATUS AND METHOD FOR MONITORING THE SAME

(71) Applicant: DYNASCAN TECHNOLOGY CORP., Taoyuan (TW)

(72) Inventors: Tsun-I Wang, Taoyuan (TW); Ching-Chun Wu, Taoyuan (TW); Chia-Liang Yang, Taoyuan (TW)

(73) Assignee: DYNASCAN TECHNOLOGY CORP., Taoyuan (TW)

( * ) Notice: Subject to any disclaimer, the term of this patent is extended or adjusted under 35 U.S.C. 154(b) by 0 days.

(21) Appl. No.: 16/226,784

(22) Filed: Dec. 20, 2018

(65) Prior Publication Data

US 2020/0202799 A1 Jun. 25, 2020

(51) Int. Cl.
*G09G 3/34* (2006.01)
*G09G 3/00* (2006.01)

(52) U.S. Cl.
CPC ..... *G09G 3/3406* (2013.01); *G09G 3/006* (2013.01); *G09G 2320/0626* (2013.01); *G09G 2330/12* (2013.01); *G09G 2360/144* (2013.01); *G09G 2360/145* (2013.01)

(58) Field of Classification Search
USPC ..... 345/102
See application file for complete search history.

(56) References Cited

U.S. PATENT DOCUMENTS 9,530,381 B1 * 12/2016 Bozarth ..... G09G 3/2003
2002/0171618 A1 * 11/2002 Lowles ..... G09G 3/3406 345/102
2004/0257318 A1 * 12/2004 Itoh ..... G09G 3/3406 345/87
2007/0229452 A1 * 10/2007 Sano ..... G02F 1/136209 345/102
2007/0241988 A1 * 10/2007 Zerphy ..... G06F 3/1431 345/1.1
2008/0062115 A1 3/2008 Brown
2013/0100096 A1 * 4/2013 Webster ..... G09G 3/3466 345/207
2017/0061898 A1 * 3/2017 Takayanagi ..... G09G 3/3406
2017/0301273 A1 * 10/2017 Atkinson ..... G06F 3/0421
2018/0336776 A1 * 11/2018 Liu ..... G01J 1/0271
2019/0340982 A1 * 11/2019 Kim ..... H05B 47/11

FOREIGN PATENT DOCUMENTS

JP 2008/00909 * 1/2008
WO WO 2004/097783 11/2004

OTHER PUBLICATIONS

Extended European Search Report dated Apr. 14, 2020 for related EP Application No. 19000579.3. pp. 1-7.

* cited by examiner

*Primary Examiner* — Roberto W Flores
(74) *Attorney, Agent, or Firm* — Duane Morris LLP

(57) ABSTRACT

The present disclosure relates to a display apparatus and a method for monitoring the same. A display apparatus is provided. The display apparatus comprises a display unit, a backlight module, a light sensor, and a controller. The backlight module is located on a first side of the display unit. The light sensor is located on a second side of the display unit different from the first side. The light sensor faces away from the display unit for detecting light comprising ambient light and reflected light from the display unit and generates a first brightness value. The controller determines the display apparatus malfunction based on the first brightness value.

21 Claims, 7 Drawing Sheets

DISPLAY APPARATUS AND METHOD FOR MONITORING THE SAME

BACKGROUND

1. Field of the Disclosure

The present disclosure relates to a display apparatus and a method for operating the same. More particularly, the present disclosure relates to a display apparatus and a method for monitoring whether the display apparatus functions properly.

2. Description of the Related Art

As display apparatuses are widely used in different environments, how to ensure the reliability and robustness of display apparatuses under harsh conditions has become an important issue. For example, if a display apparatus is placed outdoors, the display apparatus may be exposed to sunlight, wind, and rain. The outdoor operating conditions may cause problems such as deterioration of the backlight module or display unit and accidental shut-down of components of the display apparatus.

In view of the above, there is a need to provide a display apparatus with a self-detection capability, so as to ensure that the display apparatus is functioning properly. There is also a need for the administrator or owner of the display apparatus or an advertiser to monitor whether the display apparatus is functioning properly.

SUMMARY

In one aspect according to some embodiments, a display apparatus comprises a display unit, a backlight module, a light sensor, and a controller. The backlight module is located on a first side of the display unit. The light sensor is located on a second side of the display unit different from the first side. The light sensor faces away from the display unit for detecting light comprising ambient light and reflected light from the display unit and generates a first brightness value. The controller determines the display apparatus malfunction based on the first brightness value.

In a preferred embodiment, the controller further controls the backlight module based on the first brightness value.

In one aspect according to some embodiments, a method for monitoring a display apparatus comprises detecting light comprising ambient light and reflected light from the display apparatus; generating a first brightness value based on the detected light; and determining a display apparatus malfunction based on the first brightness value.

In a preferred embodiment, the method further comprises controlling the backlight of the display apparatus based on the first brightness value.

Other aspects and embodiments of the present disclosure are also contemplated. The foregoing summary and the following detailed description are not meant to limit the present disclosure to any particular embodiment but are merely meant to describe some embodiments of the present disclosure.

BRIEF DESCRIPTION OF THE DRAWINGS

For a better understanding of the nature and objects of some embodiments of the present disclosure, reference should be made to the following detailed description taken in conjunction with the accompanying drawings. In the drawings, identical or functionally identical elements are given the same reference numbers unless otherwise specified.

DETAILED DESCRIPTION

Figure 1:
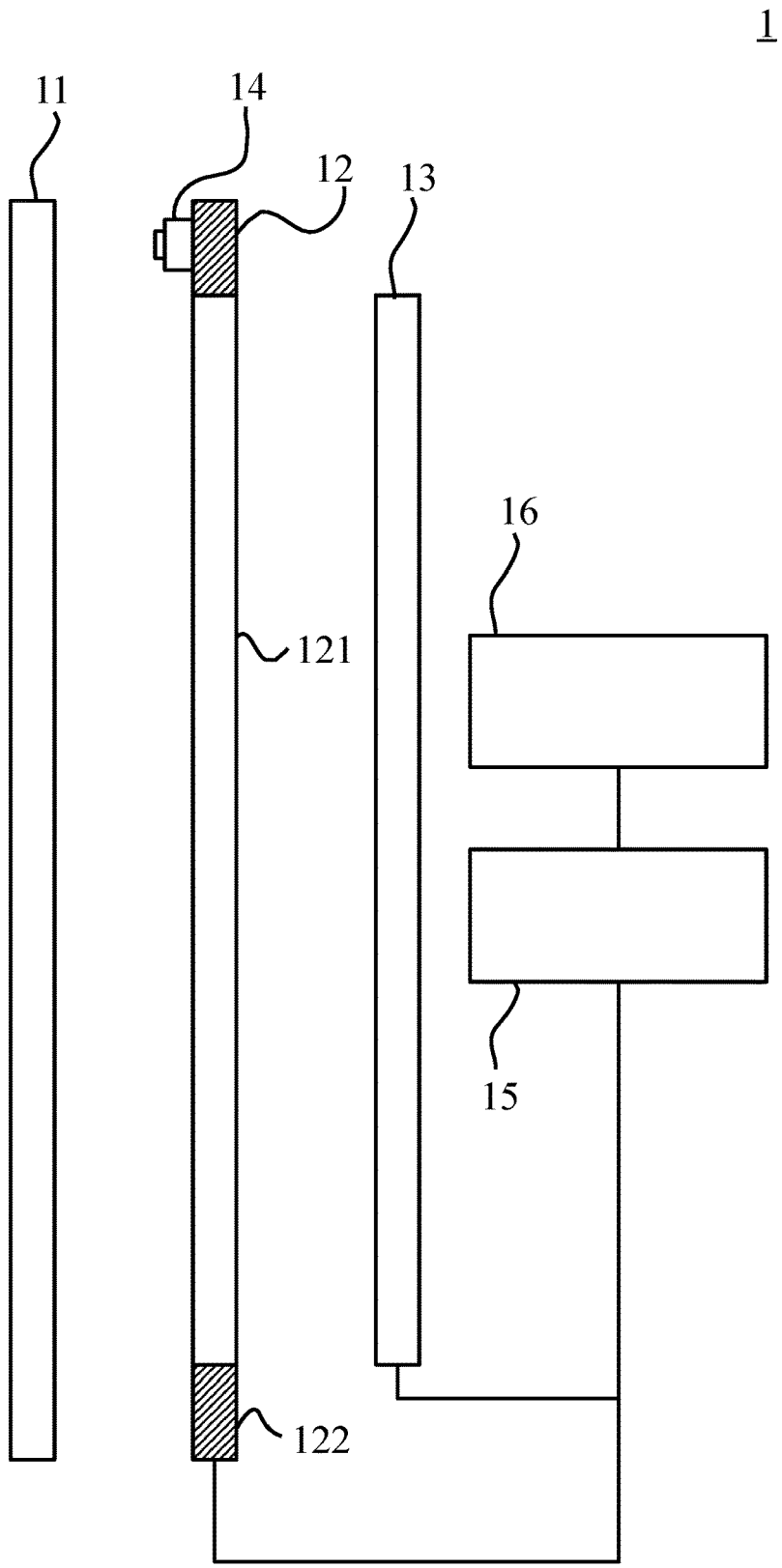
FIG. 1 illustrates a display apparatus according to some embodiments of the present disclosure.

FIG. 1 illustrates a display apparatus 1 according to some embodiments of the present disclosure. As shown in FIG. 1, the display apparatus 1 includes a protective plate 11, a display unit 12, a backlight module 13, a sensing device 14, a controller 15, and a communication module 16. The display unit 12 includes a display area 121 and a non-display area 122. The display area 121 may be surrounded by the non-display area 122. The communication module 16 may communicate with any external apparatus through a wired connection and/or a wireless connection. The controller 15 electrically connects to and communicates with the display unit 12, the backlight module 13, the sensing device 14, and/or the communication module 16. In some embodiments, the controller 15 may control the display unit 12, the backlight module 13, the sensing device 14, and the communication module 16.

The display unit 12 may include a liquid crystal layer. In some embodiments, the backlight module 13 may be a direct backlight module including a plurality of light sources and a backlight assembly for mounting the light sources. The light sources can be, for example, a plurality of LEDs, which may be placed on the front surface of the backlight assembly to provide backlight illumination for the display unit 12. In some embodiments, the backlight module 13 may be an edge-lit backlight module including a light source for side illumination and a light guiding plate. One or more optical films may be included in the display unit 12, the backlight module 13, or both, and can be, for example, a light diffuser, a light reflector, a brightness enhancement film, or a combination of two or more thereof. The type and the number of optical films to be used are not limited here.

In a preferred embodiment, the sensing device 14 is disposed on the display unit 12. The sensing device 14 is disposed on the non-display area 122 instead of the display area 121 of the display unit 12. Thus, the sensing device 14 would not block a portion of the display area 121. In a preferred embodiment, the sensing device 14 is disposed facing away from the display unit 12 and facing toward the protective plate 11. The protective plate 11 can be made of tempered glass or other transparent material with higher strength.

The sensing device 14 may detect or measure the magnitude of light and generate a corresponding brightness value. In some embodiments, the sensing device 14 may be a light detector or a light sensor. The sensing device 14 may detect or measure light from different sources, such as ambient light passing through the protective plate 11 and light emitted by the backlight module 13 passing through the display unit 12 and then reflected by the protective plate 11. Thus, the brightness value generated by the sensing device 14 may present both the brightness of the environment in which the display apparatus 1 is placed and the brightness of light emitted by the display apparatus itself. Thus, the sensing device 14 can be used for detecting the ambient light and for determining whether the display apparatus functions properly. The sensing device 14 may be any device that is capable to detect or measure the magnitude of light and is not limited by the above embodiments. For example, the sensing device 14 may be an image capturing device, such as camera.

The controller 15 may control the backlight module 13 based on the brightness value generated by the sensing device 14. The controller 15 may adjust the backlight module 13 based on the brightness of ambient light. For example, if the environment is very bright, the brightness value generated by the sensing device 14 may be higher than a threshold for a time period (e.g., 10 minutes). In this case, the controller 15 may control the backlight module 13 to increase its brightness, so that the viewer can see the displayed image easily. On the other hand, if the environment is very dark, the brightness value generated by the sensing device 14 may be lower than another threshold for a time period (e.g., 10 minutes). In this case, the controller 15 may control the backlight module 13 to decrease its brightness so as to save power and avoid the glare. Additionally, the controller 15 can determine whether the display apparatus 1 functions properly and the detailed description will be provided in the paragraphs related to FIGS. 3-5.

Figure 2:
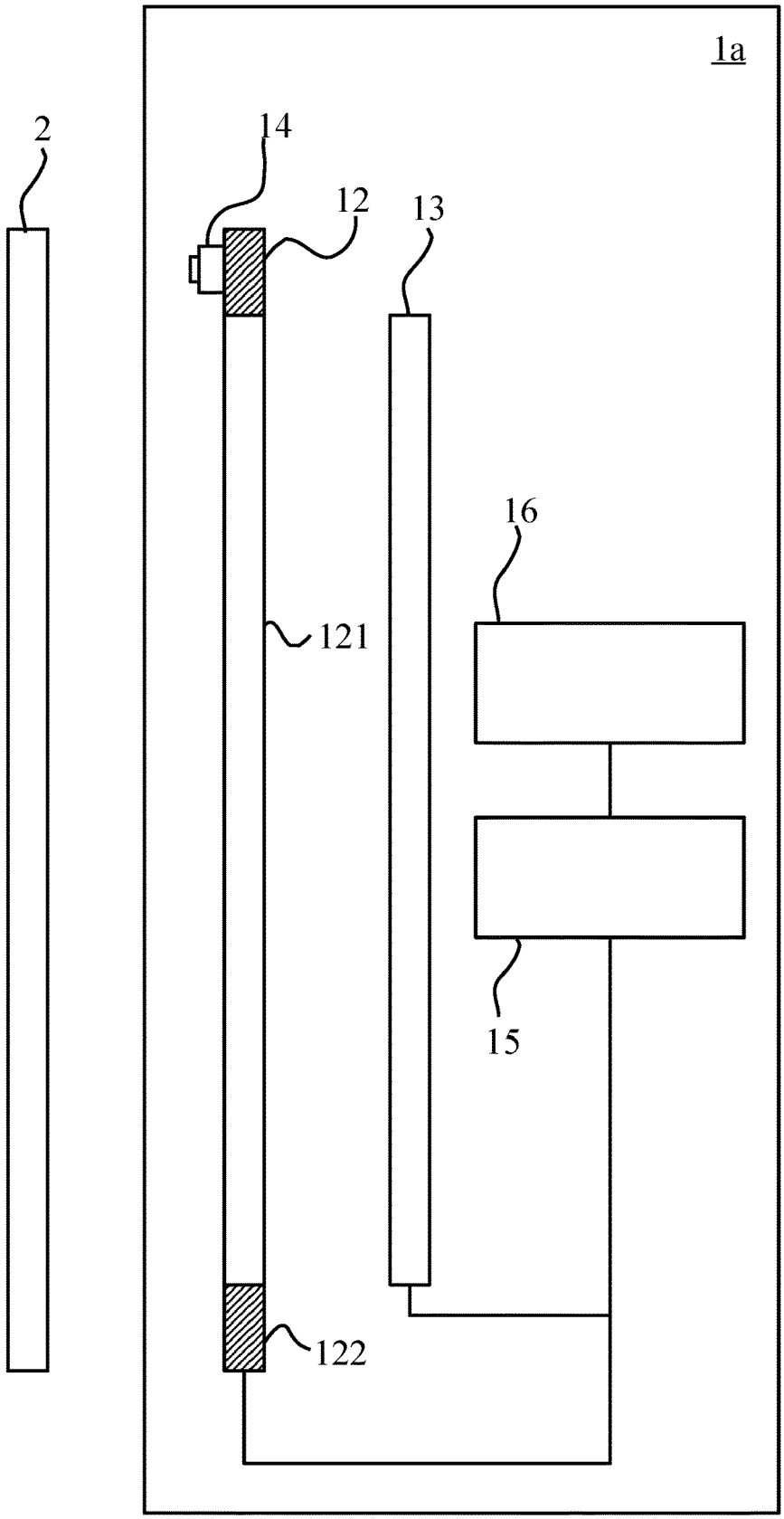
FIG. 2 illustrates a display apparatus and a transparent plate according to some embodiments of the present disclosure.

FIG. 2 illustrates a display apparatus 1*a* according to some embodiments of the present disclosure. The display apparatus 1*a* shown in FIG. 2 is similar to the display apparatus 1 shown in FIG. 1. The components of the display apparatus 1*a* in FIG. 2 with the same reference numerals as those of the display apparatus 1 in FIG. 1 refer to the same or similar components, and thus their detailed descriptions are not repeated here. Different from FIG. 1, the display apparatus 1*a* is placed behind a transparent plate 2. The transparent plate 2 may be a glass plate of a window of a store, and thus is not a part of the display apparatus 1*a*. Although the display apparatus 1*a* is placed behind the transparent plate 2, in some embodiments, the display unit 12 may still include a protective layer (not shown) on one side of the display unit 12 opposite to the side of the display unit 12 near the backlight module 13.

In a preferred embodiment, the sensing device 14 faces toward the transparent plate 2 and faces away from the display unit 12. The sensing device 14 may be capable to detect or measure the magnitude of light and generate a corresponding brightness value. The sensing device 14 may detect or measure light from different sources, such as ambient light passing through the transparent plate 2 and light emitted by the backlight module 13 passing through the display unit 12 and then reflected by the transparent plate 2. Since the sensing device 14 may detect light reflected by the transparent plate 2 from the display unit 12 and the backlight module 13, the sensing device 14 may be used to determine whether the display apparatus functions properly. Furthermore, since the sensing device 14 may detect ambient light, the brightness value generated by the sensing device 14 can be used to adjust the backlight module 13 as mentioned above.

Please note that although the sensing device 14 is mounted on the display unit 12 in FIG. 1 and FIG. 2, it can also be embedded in the display unit 12, attached to the periphery of the display unit 12, mounted on a housing of the display apparatus 1 (or 1*a*) or placed in other manners as long as it can detect light reflected by the transparent plate 2 or the protective plate 11.

In addition to sensing ambient light, the sensing device 14 in combination with the controller 15 can also be used to determine whether the display apparatus 1 (or 1*a*) functions properly. For example, if the backlight module 13 is broken and the display unit 12 functions properly, the brightness of the display apparatus 1 (or 1*a*) become very low and viewers may not be able to see the displayed content. In this situation, the sensing device 14 may detect or measure only ambient light, and the generated brightness value would remain a low and almost constant value for a long time period, such as 10 minutes. Thus, the controller 15 may determine that a display apparatus malfunction has occurred based on the generated brightness value.

Figure 3:
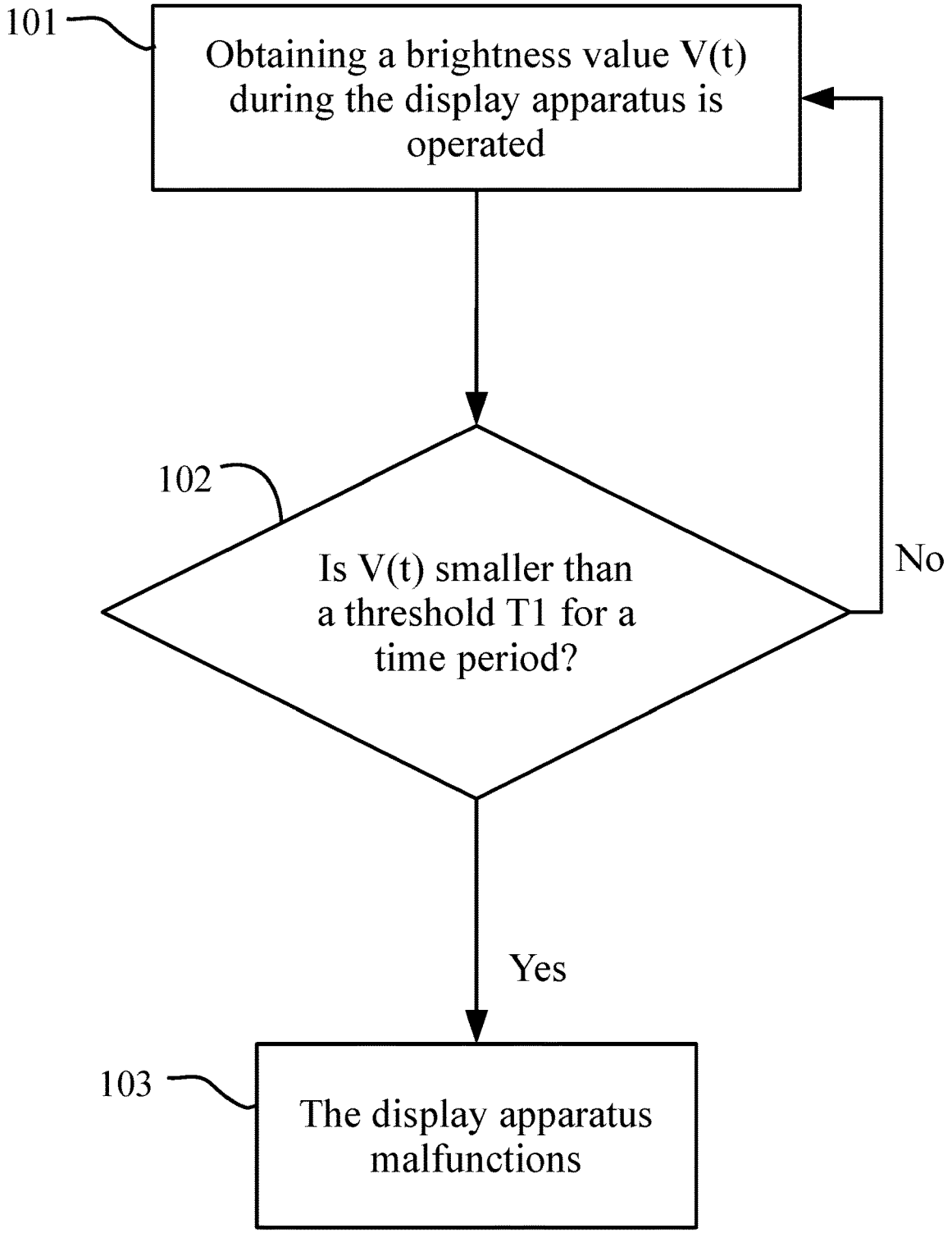
FIG. 3 is a flow chart for monitoring a display apparatus according to some embodiments of the present disclosure.

FIG. 3 is a flow chart for monitoring a display apparatus according to some embodiments of the present disclosure. In some embodiments, the flow chart in FIG. 3 is performed by the controller 15 of the display apparatus 1 (or 1*a*). During operation of the display apparatus 1 (or 1*a*), the sensing device 14 detects or measures the light and generates the corresponding brightness values. The sensing device 14 may generate brightness values at different times. The brightness values generated by the sensing device 14 may be expressed as a function associated with time. For example, the brightness values generated by the sensing device 14 may be expressed as:

V(t), in which t refers to time.

In operation 101, the controller 15 obtains the brightness value V(t) from the sensing device 14. In operation 102, the controller 15 determines whether the brightness V(t) is smaller than a threshold T1 for a preconfigured time period. If so, the controller 15 determines the occurrence of the display apparatus malfunction (operation 103); otherwise, the controller 15 performs operation 101 again. For example, if the time period is set as 10 minutes and a brightness value is obtained every second, then the controller 15 may determine that the brightness of the display apparatus 1 (or 1*a*) is too low if 600 continuous brightness values are lower than the threshold T1. In some embodiments, the determination of operation 102 may be expressed as:

$V(t)<T1$ for every tin the range from $(t1-m+1)$ to t1, in which t1 denotes the current time and m is an integer and is determined based on the preconfigured time period and the rate of obtaining brightness values.

Otherwise, the controller 15 determines that the display apparatus 1 (or 1*a*) functions properly and performs operation 101.

In some embodiments, the threshold T1 is a preconfigured value. In some other embodiments, the threshold T1 is determined based on the brightness values Vw and Vb, where Vw is the brightness value when the display unit 12 displays a white image, and Vb is the brightness value when the display unit 12 displays a black image. In some embodiments, the threshold T1 equals to:

$C1*(Vw-Vb)+Vb$, in which C1 is between 0 and 1.

Vw and Vb may be generated during the initialization stage of the display apparatus 1 (or 1*a*) or during normal operation of the display apparatus 1 (or 1*a*). In some embodiments, Vw and Vb are fixed values and the threshold T1 is preconfigured. Thus, the calculation of the threshold T1 can be skipped during the operation of the display apparatus.

Figure 4:
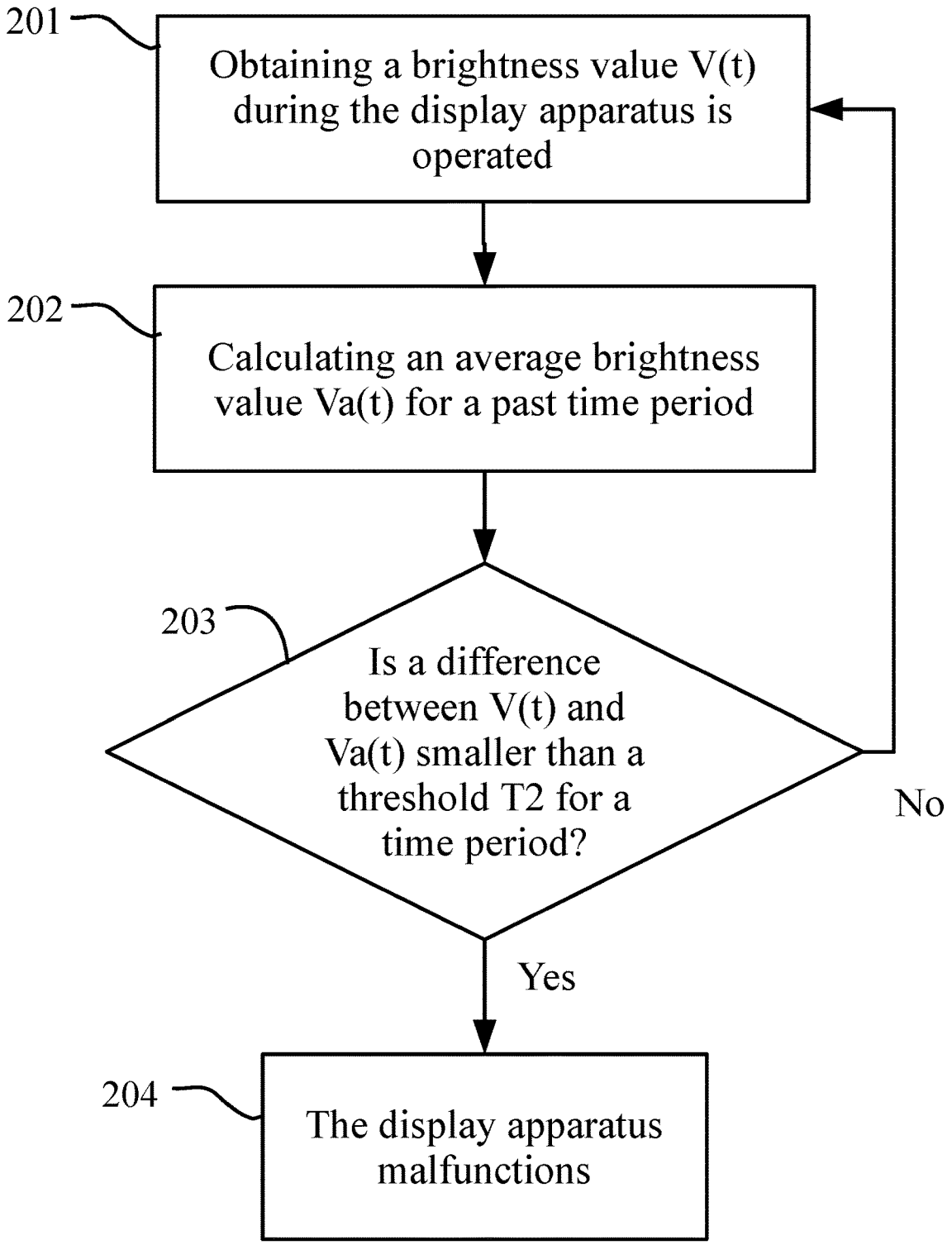
FIG. 4 is a flow chart for monitoring a display apparatus according to some embodiments of the present disclosure.

FIG. 4 is a flow chart for monitoring a display apparatus according to some embodiments of the present disclosure. The flow chart in FIG. 4 is performed by the controller 15 of display apparatus 1 (or 1*a*). During operation of the display apparatus 1 (or 1*a*), the sensing device 14 detects or measures the light and generates the corresponding brightness values. The sensing device 14 may generate brightness values at different time. The brightness values generated by the sensing devices 14 may be expressed as a function associated with time. For example, the brightness values generated by the sensing devices 14 may be expressed as:

V(t), in which t refers to time.

In operation 201, the controller 15 obtains the brightness value V(t) from the sensing device 14. In operation 202, the controller 15 calculates an average brightness value Va(t) for a past time period. In some embodiments, the average brightness value Va(t) is an average value of V(t−n+1) to V(t), in which n is a preconfigured integer. In operation 203, the controller 15 determines whether the difference between V(t) and Va(t) is smaller than a threshold T2 for a preconfigured time period. In some embodiments, the determination of operation 203 may be expressed as:

$|V(t)-Va(t)|<T2$ for every t in the range from (t2−m+1) to t2, in which t2 denotes the current time and m is an integer which is determined based on the preconfigured time period and the rate of obtaining the brightness values. For example, if the preconfigured time period is 10 seconds and a brightness value is obtained every 2 ms, then m is equal to 5,000.

The difference between V(t) and Va(t) being smaller than a threshold T2 for a preconfigured time period means that the displayed content may be still. It may be caused by malfunction of the display unit (e.g., still image) or malfunction of the backlight module. Thus, the controller 15 determines that the display apparatus malfunctions (i.e., operation 204) if the difference between V(t) and Va(t) is smaller than a threshold T2 for a preconfigured time period. Otherwise, the controller 15 determines that the display apparatus 1 (or 1*a*) functions properly and performs operation 201. If the controller 15 determines that the display apparatus 1 (or 1*a*) malfunctions, the controller 15 may further alarm a remote user through the communication module 16.

In some embodiments, the threshold T2 is a preconfigured value. In some other embodiments, the threshold T2 is determined based on the brightness values Vw and Vb, where Vw is the brightness value when the display unit 12 displays a white image, and Vb is the brightness value when the display unit 12 displays a black image. In some embodiments, the threshold T2 equals to:

C2*(Vw−Vb), in which C2 is between 0 and 1.

In some embodiments, the brightness values Vw and Vb are preconfigured before the operation 201. Thus the threshold T2 is preconfigured before the operation 201, and the calculation of the threshold T2 can be skipped during the operation of the display apparatus 1 (or 1*a*). In some embodiments, Vw and Vb may be generated during the initialization stage of the display apparatus 1 (or 1*a*) or during normal operation of the display apparatus 1 (or 1*a*).

Figure 5A:
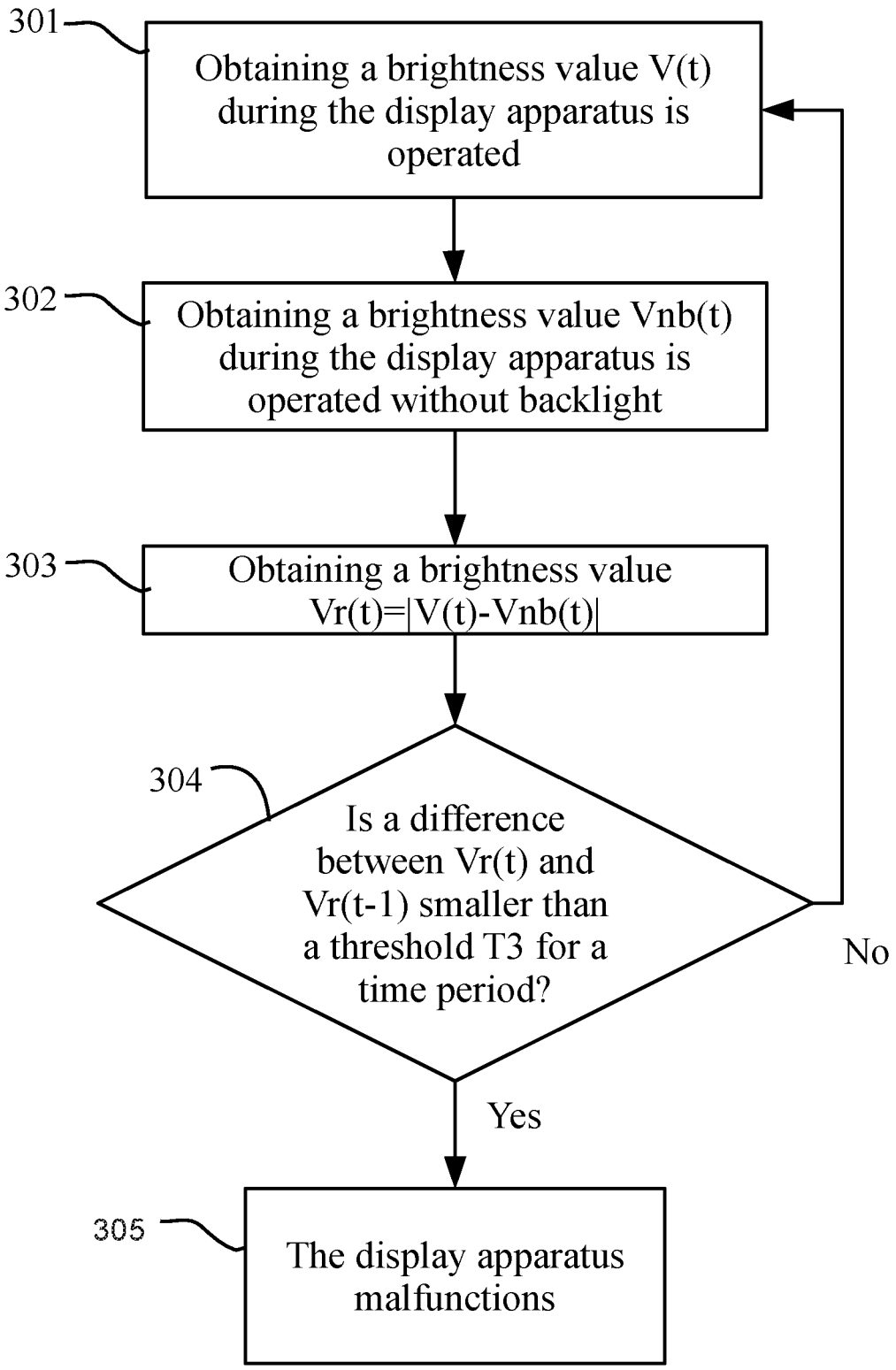
FIG. 5A is a flow chart for monitoring a display apparatus according to some embodiments of the present disclosure.

FIG. 5A is a flow chart for monitoring a display apparatus according to some embodiments of the present disclosure. The flow chart in FIG. 5A is performed by the controller 15 of display apparatus 1 (or 1*a*). When the display apparatus 1 (or 1*a*) is operated (e.g., displaying images or videos), the sensing device 14 detects or measures the light and generates the corresponding brightness values. The sensing device 14 may generate brightness values at different time or different frames. The brightness values generated by the sensing devices 14 may be expressed as a function associated with time or as a function associated with the ordinal number of frame. For example, the brightness values generated by the sensing devices 14 may be expressed as:

V(t), in which t refers to time or the ordinal number of frame.

In operation 301, the controller 15 obtains the brightness value V(t) from the sensing device 14.

When the display apparatus 1 (or 1*a*) displays images or videos, the display apparatus 1 (or 1*a*) may turn off the backlight module 13 for short time. In some embodiments, the short time for which the backlight module 13 is turned off may be a portion of one frame. When the display apparatus 1 (or 1*a*) is operated (e.g., displaying images or videos) without the backlight, the sensing device 14 detects or measures the light and generates the corresponding brightness values. The sensing device 14 may generate brightness values without the backlight at different time or different frames. The brightness values without the backlight generated by the sensing devices 14 may be expressed as a function associated with time or as a function associated with the ordinal number of frame. For example, the brightness values generated by the sensing devices 14 may be expressed as:

Vnb(t), in which t refers to time or the ordinal number of frame.

In operation 302, the controller 15 obtains the brightness value Vnb(t) from the sensing device 14.

Figure 5B:
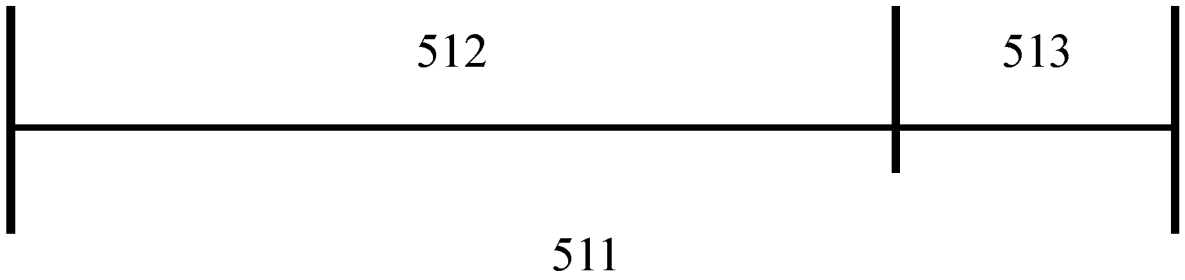
FIG. 5B illustrates a frame according to some embodiments of the present disclosure.

FIG. 5B illustrates a frame 511 according to some embodiments of the present disclosure. In FIG. 5B, the frame 511 is divided into two portions 512 and 513. In some embodiments, the backlight module 13 is not turned off in the portion 512, and the backlight module 13 is turned off in the portion 513. In some embodiments, the operation 301 is performed in the portion 512, and the operation 302 is performed in portion 513. In some embodiments, the operation 301 is performed every frame. In some embodiments, the operation 301 is performed every several frames. In some embodiments, the operation 302 is performed every frame. In some embodiments, the operation 302 is performed every several frames. Because the operation 301 may not performed every frame, if no new brightness value V(t) is obtained, the present brightness value V(t) equals to the recently obtained brightness value V(t). Because the operation 302 may not performed every frame, if no new brightness value Vnb(t) is obtained, the current brightness value Vnb(t) equals to the recently obtained brightness value Vnb(t).

Referring to FIG. 5A again, in operation 303, the controller 15 obtains the brightness value Vr(t) from the difference between V(t) and Vnb(t).

In operation 304, the controller 15 determines whether the difference between Vr(t) and Vr(t−1) (i.e., the value Vr for the current time and the value Vr for the previous time) is smaller than a threshold T3 for a preconfigured time period, for preconfigured times, or for preconfigured frames. In some embodiments, the determination of operation 303 may be expressed as:

$|Vr(t)-Vr(t-1)|<T3$ for every t in the range from (t3−m+1) to t3, in which t3 denotes the current time and m is an integer which is determined based on the preconfigured time period and the rate of obtaining the brightness values. For example, if the preconfigured time period is 10 seconds and a brightness value is obtained every 2 ms, then m is equal to 5,000.

The difference between Vr(t) and Vr(t−1) being smaller than a threshold T3 for a preconfigured time period means that the displayed content may be still. It may be caused by malfunction of the display unit (e.g., still image) or malfunction of the backlight module. Thus, the controller 15 determines that the display apparatus malfunctions (i.e., operation 305) if the difference between Vr(t) and Vr(t−1) is smaller than a threshold T3 for a preconfigured time period. Otherwise, the controller 15 determines that the display apparatus 1 (or 1*a*) functions properly and performs operation 301. If the controller 15 determines that the display apparatus malfunctions, the controller 15 may further alarm a remote user through the communication module 16.

In some embodiments, the threshold T3 is a preconfigured value. In some other embodiments, the threshold T3 is determined based on the brightness values Vw and Vb, where Vw is the brightness value when the display unit 12 displays a white image, and Vb is the brightness value when the display unit 12 displays a black image. In some embodiments, the threshold T3 equals to:

C3*(Vw−Vb), in which C3 is between 0 and 1.

In some embodiments, the brightness values Vw and Vb are preconfigured before the operation 301. Thus, the threshold T3 is preconfigured before the operation 301, and the calculation of the threshold T3 can be skipped during the operation of the display apparatus 1 (or 1*a*). In some embodiments, Vw and Vb may be generated during the initialization stage of the display apparatus 1 (or 1*a*) or during normal operation of the display apparatus 1 (or 1*a*).

Figure 6:
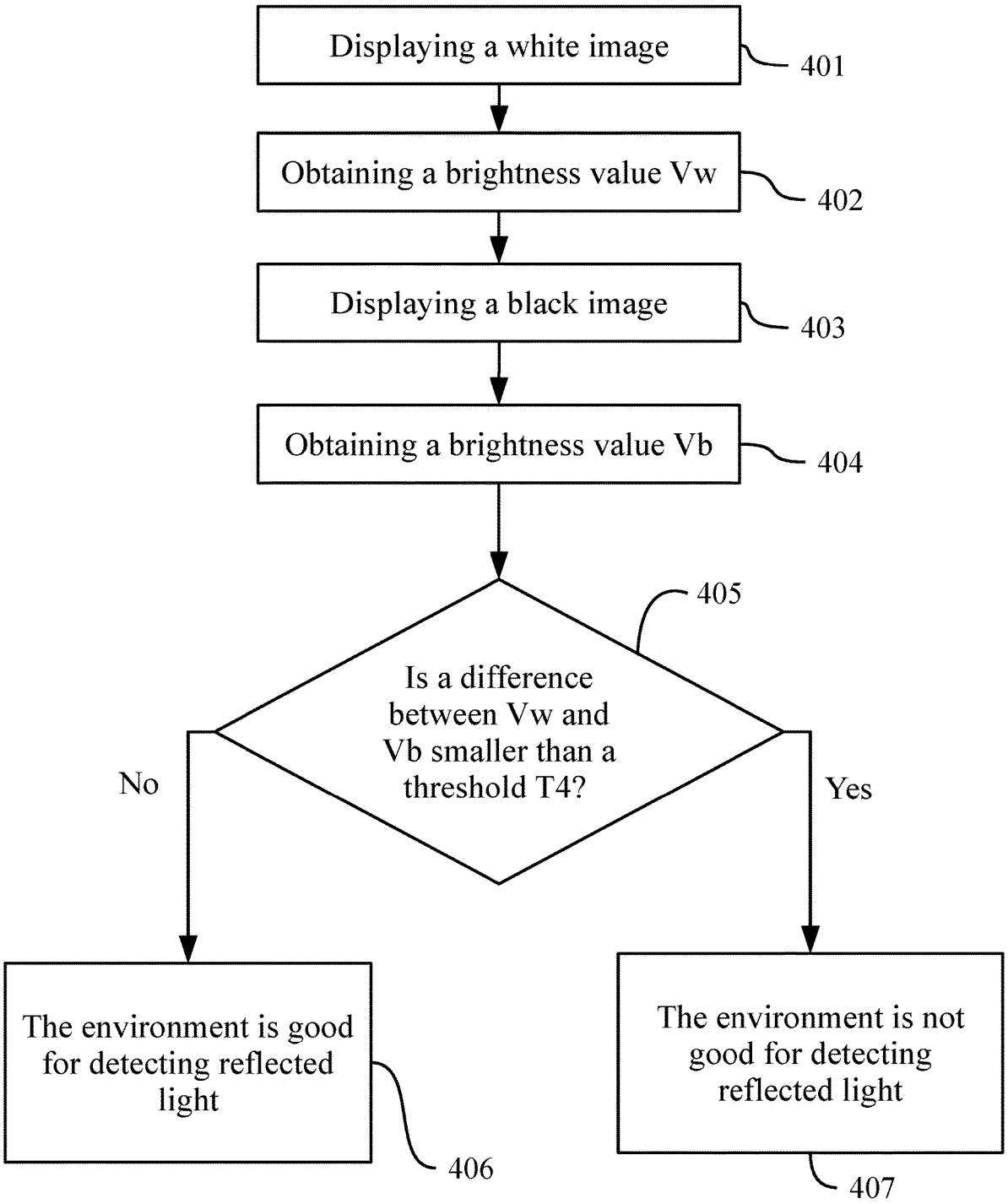
FIG. 6 is a flow chart for monitoring a display apparatus according to some embodiments of the present disclosure.

FIG. 6 is a flow chart for monitoring a display apparatus 1 (or 1*a*) according to some embodiments of the present disclosure. The flow chart in FIG. 6 is performed by the controller 15 of display apparatus 1 (or 1*a*). In some embodiments, the operations shown in FIG. 6 are performed when the display apparatus 1 (or 1*a*) boots up and may be combined with the operations shown in FIG. 3 4, or 5A. In operation 401, the controller 15 controls the display unit 12 to display a white image. The sensing device 14 detects or measures the light to generate a brightness value Vw when the display unit 12 displays the white image. In operation 402, the controller 15 obtains the brightness value Vw from the sensing device 14. In operation 403, the controller 15 controls the display unit 12 to display a black image. The sensing device 14 detects or measures the light to generate a brightness value Vb when the display unit 12 displays the black image. In operation 404, the controller 15 obtains the brightness value Vb from the sensing device 14. Normally, the brightness value Vw is larger than the brightness value Vb.

In operation 405, the controller 15 determines whether the difference between Vw and Vb is smaller than a threshold T4. If the difference between Vw and Vb is not smaller than the threshold T4, the controller 15 determines that the environment of the display apparatus 1 (or 1*a*) is good for detecting the light reflected by the transparent plate 2 or the protective plate 11 (i.e., operation 406). Such environment may be good for the operations shown in FIG. 3 4, or 5A. In some embodiment according to the present disclosure, if the difference between Vw and Vb is smaller than the threshold T4, the controller 15 determines that the environment of the display apparatus 1 (or 1*a*) is not good for detecting the light reflected by the transparent plate 2 or the protective plate 11 (i.e., operation 407). Such environment may be not good for the operations shown in FIG. 3 4, or 5A.

In some embodiment according to the present disclosure, the result of the operation 405 may be used to determine whether the display apparatus 1 (or 1*a*) functions properly. If the difference between Vw and Vb is not smaller than the threshold T4, the controller 15 determines that the display apparatus 1 (or 1*a*) functions properly (i.e., operation 406). If the difference between Vw and Vb is smaller than the threshold T4, the controller 15 determines that the display apparatus 1 (or 1*a*) has malfunctioned (i.e., operation 407). For example, if the display unit 12 malfunctions or if the backlight module 13 malfunctions, the displayed image may not change. Thus, the difference between Vw and Vb may be smaller than the threshold T4 and it can be determined that the display apparatus 1 (or 1*a*) has malfunctioned. The controller 15 may further alarm a remote user through the communication module 16.

In some embodiments, the threshold T4 is determined based on values Vwp and Vbp. The value Vwp refers to the brightness value when the display apparatus 1 (or 1*a*) normally displays a white image. The value Vbp refers to the brightness value when the display apparatus 1 (or 1*a*) normally displays a black image. Values Vwp and Vbp may be preconfigured values or may be an average of Vw and an average of Vb obtained by the controller 15 at different times. In some embodiments, the threshold T4 equals to:

C4*(Vwp−Vbp), in which C4 is between 0 and 1.

In some embodiments, the determination in operation 405 can be expressed as:

(Vw−Vb)<C4*(Vwp−Vbp).

In some embodiments the threshold T4 is preconfigured, thus the operation calculating the threshold T4 can be skipped.

As used herein, the singular terms "a," "an," and "the" may include plural referents unless the context clearly indicates otherwise. For example, reference to an electronic device may include multiple electronic devices unless the context clearly indicates otherwise.

As used herein, the terms "connect," "connected," and "connection" refer to an operational coupling or linking. Connected components can be directly or indirectly coupled to one another through, for example, another set of components.

Additionally, amounts, ratios, and other numerical values are sometimes presented herein in a range format. It is to be understood that such range format is used for convenience and brevity and should be understood flexibly to include numerical values explicitly specified as limits of a range, but also to include all individual numerical values or sub-ranges encompassed within that range as if each numerical value and sub-range is explicitly specified.

While the present disclosure has been described and illustrated with reference to specific embodiments thereof, these descriptions and illustrations are not limiting. It should be understood by those skilled in the art that various changes may be made and equivalents may be substituted without departing from the true spirit and scope of the present disclosure as defined by the appended claims. The illustrations may not be necessarily drawn to scale. There may be distinctions between the artistic renditions in the present disclosure and the actual apparatus due to manufacturing processes and tolerances. There may be other embodiments of the present disclosure which are not specifically illustrated. The specification and drawings are to be regarded as illustrative rather than restrictive. Modifications may be made to adapt a particular situation, material, composition of matter, method, or process to the objective, spirit and scope of the present disclosure. All such modifications are intended to be within the scope of the claims appended hereto. While the methods disclosed herein have been described with reference to particular operations performed in a particular order, it will be understood that these operations may be combined, sub-divided, or re-ordered to form an equivalent method without departing from the teachings of the present disclosure. Accordingly, unless otherwise specifically indicated herein, the order and grouping of the operations are not limitations of the present disclosure.

What is claimed is:

1. A display apparatus, comprising:

a display unit;

a backlight module located on a back side of the display unit;

a light sensor located on a front side of the display unit, the front side being a side that emits light and displays images to a user of the display apparatus, the front side being opposite the back side, and wherein the light sensor faces away from the display unit for detecting and generating a first brightness value of light comprising a combination of ambient light and reflected light, wherein the reflected light is emitted by the backlight module, passes through the display unit and is then reflected back to the light sensor by a transparent plate placed in front of the display apparatus on the front side of the display unit, and wherein the ambient light and the reflected light are simultaneously detected by the light sensor; and a controller that determines whether the display apparatus is malfunctioning based on the first brightness value, wherein the controller determines the display apparatus is malfunctioning when a difference between the first brightness value and an average value of the first brightness value for a past time period is lower than a second threshold for a time period.

2. The display apparatus of claim 1, wherein the controller determines the display apparatus is malfunctioning when the first brightness value is lower than a first threshold for a time period.

3. The display apparatus of claim 1, wherein the controller further controls the backlight module based on the first brightness value.

4. The display apparatus of claim 1, wherein the light sensor is located on the display unit and outside a display area of the display unit.

5. The display apparatus of claim 1, further comprising a protective plate on the front side of the display unit, and the reflected light is reflected by the protective plate.

6. A display apparatus, comprising:

a display unit;

a backlight module located on a back side of the display unit;

a light sensor located on a front side of the display unit, the front side being a side that emits light and displays images to a user of the display apparatus, the front side being opposite the back side, and wherein the light sensor faces away from the display unit for detecting and generating a first brightness value of light comprising a combination of ambient light and reflected light, wherein the reflected light is emitted by the backlight module, passes through the display unit and is then reflected back to the light sensor by a transparent plate placed in front of the display apparatus on the front side of the display unit, and wherein the ambient light and the reflected light are simultaneously detected by the light sensor; and a controller that determines whether the display apparatus is malfunctioning based on the first brightness value, wherein the light sensor detects light when the backlight module is turned off and generates a second brightness value; the controller determines a third brightness value for a current time based on a difference between the first brightness value and the second brightness value; the controller determines that the display apparatus is malfunctioning when a difference between the third brightness value for the current time and the third brightness value for a previous time is lower than a third threshold for a time period.

7. The display apparatus of claim 6, wherein the light sensor detects a fourth brightness value when the display unit displays a white image, and detects a fifth brightness value when the display unit displays a black image, and the third threshold is determined based on the fourth brightness value and the fifth brightness value.

8. The display apparatus of claim 7, wherein the third threshold is equal to a portion of a difference between the fourth brightness value and the fifth brightness value.

9. The display apparatus of claim 7, wherein the controller is further configured to determine an environment of the display apparatus based on a difference between the fourth brightness value and the fifth brightness value and a fourth threshold.

10. The display apparatus of claim 6, wherein the controller determines the display apparatus is malfunctioning when the first brightness value is lower than a first threshold for a time period.

11. The display apparatus of claim 6, wherein the controller further controls the backlight module based on the first brightness value.

12. The display apparatus of claim 6, wherein the light sensor is located on the display unit and outside a display area of the display unit.

13. The display apparatus of claim 6, further comprising a protective plate on the front side of the display unit, and the reflected light is reflected by the protective plate.

14. A method for monitoring a display apparatus having a display unit, a backlight module located on a back side of the display unit, and a light sensor located on a front side of the display unit, the front side being a side that emits lights and displays images to a user of the display apparatus, the front side being opposite the back side, the light sensor facing away from the display unit, the method comprising:

by use of the light sensor, detecting light comprising a combination of ambient light and reflected light, wherein the reflected light is emitted by the backlight module, passes through the display unit and is then reflected back to the light sensor by a transparent plate placed in front of the display apparatus on the front side of the display unit, and wherein the ambient light and the reflected light are simultaneously detected by the light sensor;

generating a first brightness value based on the detected light; and determining whether the display apparatus is malfunctioning based on the first brightness value.

15. The method of claim 14, further comprising determining that the display apparatus is malfunctioning when the first brightness value is lower than a first threshold for a time period.

16. The method of claim 14, further comprising determining that the display apparatus is malfunctioning when a difference between the first brightness value and an average value of the first brightness value for a past time period is lower than a second threshold for a time period.

17. The method of claim 14, further comprising:

generating a second brightness value by detecting light when a backlight module of the display apparatus is turned off;

determining a third brightness value for a current time based on the first brightness value and the second brightness value;

determining the display apparatus is malfunctioning when a difference between the third brightness value for the current time and the third brightness value for a previous time is lower than a third threshold for a time period.

18. The method of claim 17, further comprising: detecting a fourth brightness value when the display apparatus displays a white image; detecting a fifth brightness value when the display apparatus displays a black image; and determining the third threshold based on the fourth brightness value and the fifth brightness value.

19. The method of claim 18, wherein the third threshold is equal to a portion of a difference between the fourth brightness value and the fifth brightness value.

20. The method of claim 18, further comprising determining an environment of the display apparatus based on a difference between the fourth brightness value and the fifth brightness value and a fourth threshold.

21. The method of claim 14, further comprising controlling a backlight of the display apparatus based on the first brightness value.

* * * * *